US005185075A

United States Patent [19]

Rosenberg et al.

[11] Patent Number: 5,185,075

[45] Date of Patent: Feb. 9, 1993

[54] SURFACE TREATED TITANIUM/TITANIUM ALLOY ARTICLES AND PROCESS FOR PRODUCING

[75] Inventors: Harry W. Rosenberg, Pittsburgh, Pa.; Brian Melody, Bowling Green, Ky.

[73] Assignee: The Alta Group, Fombell, Pa.

[21] Appl. No.: 603,287

[22] Filed: Oct. 25, 1990 (Under 37 CFR 1.47)

[51] Int. Cl.[5] ..... C25D 11/26

[52] U.S. Cl. ..... 205/234

[58] Field of Search ..... 204/56.1, 58.5

[56] References Cited

U.S. PATENT DOCUMENTS 3,331,993 7/1967 Brown ..... 204/56.1

3,410,766 11/1968 Schmidt ..... 204/58.5

FOREIGN PATENT DOCUMENTS 2168383 6/1986 United Kingdom .

*Primary Examiner*—T. M. Tufariello

*Attorney, Agent, or Firm*—Paul Bogdon

[57] ABSTRACT

Surface treated titanium and titanium alloy articles having a thin anodized film substantially of $TiO_2$ and characterized by a leakage current of less than about 25 microamps per square centimeter and a dielectric strength of at least one million volts per square centimeter, together with a high breakdown potential and high corrosion resistance, is disclosed. The process for forming such titanium and titanium alloy articles is also disclosed and is characterized by anodizing the articles in a substantially non-aqueous solution of a mineral acid and an organic solvent at a formation current above 0.1 microamps per square centimeter.

31 Claims, No Drawings

SURFACE TREATED TITANIUM/TITANIUM ALLOY ARTICLES AND PROCESS FOR PRODUCING

BACKGROUND OF THE INVENTION

This invention relates to surface treated titanium and titanium alloy articles having a thin anodized film substantially of $TiO_2$ and characterized by having low leakage current, high dielectric strength, high breakdown potential, and high corrosion resistance This invention also relates to the process for forming such titanium and titanium alloy articles with the process being characterized by anodizing the articles in a substantially non-aqueous solution of a mineral acid and an organic solvent.

Titanium metal and its various alloys have two primary and significant characteristics of commercial interest, namely: high structural efficiency, and high corrosion resistance in oxidizing environments. Because of its high structural efficiency titanium metal and its alloys have had numerous aerospace applications. The high corrosion resistance of titanium and its alloys have rendered them useful in various chemical processing applications. Corrosion applications depend on the existence of a passive film of $TiO_2$ on the surface of the metal. Exposure of the metal to moist air or oxidizing aqueous media are sufficient to establish a passive film. This naturally occurring film is the basic reason why titanium is corrosion resistant in oxidizing media at ambient to the moderate temperatures used in processing aqueous media.

Pure $TiO_2$ also has high dielectric properties. However, its dielectric properties have been heretofore not extensively taken advantage of, mainly because thin films of $TiO_2$ created by known anodizing methods have been less efficient in preventing current leakage in the presence of an electrical field, as compared, for example, to $Ta_2O_5$ or $Al_2O_3$. The leakage current, as it is known, is that current that still flows across a film in response to an electrical field after anodization is completed. $TiO_2$ has found extensive use as a constituent in mixtures with other oxides in passive electronic devices such as ceramic capacitors, but has not had any known use as a pure oxide or anodized film.

Titanium may be anodized in a variety of aqueous solutions compromised of acids, bases, or salts. None of the known methods of anodizing $TiO_2$ films result in articles being produced where leakage currents are below 25 microamps per square centimeter. Dilute aqueous solutions of boric acid solutions permit anodization to high voltages but the leakage currents are also very high. Titanium has also been anodized in aqueous solutions of methyl ethyl phosphate to about 350 volts, but resulting oxide typically produces leakage currents about 40 microamps per square centimeter at about 200 volts. Other methods of anodizing titanium have been known such as that disclosed in U.S. Pat. No. 2,874,102 where titanium is disclosed to be anodized to a "desired maximum value". However, the electrolytes disclosed are significantly inefficient since they give rise to an electrically leaky oxide. Other attempts at anodizing titanium such as anodizing in fused-salt baths but have met with only partial success. The use of molten nitrate electrolytes at 300 degrees C or higher prove to be impractical and in some instances dangerous and the attempts at fused-salt anodizing where abandoned.

SUMMARY OF THE INVENTION

The titanium/titanium alloy articles of this invention are anodized by the process of this invention in a substantially non-aqueous solution. "Non-aqueous" as used throughout this specification and in the claims in reference to solutions or solvents is meant a solution containing less than about 10 vol % water. By this invention organic solvents are used for water in the anodizing solution. Organic solvents in which the action of Bronsted-Lowry (i.e. proton donating) acids is substantially subdued have been found to be suitable. The aprotic nature of a solvent is qualitatively indicated for the purpose of the present invention by the lack of visible reaction between 5 vol % solution of phosphoric acid in the solvent and granulated ammonium carbonate. Solutions of phosphoric acid in protic solvents vigorously evolve carbon dioxide gas upon the addition of ammonium carbonate. Dimethyl sulfoxide is one such example. Should completely anhydrous electrolytes be used for anodizing titanium, such as those described in U.S. Pat. Nos. 3,331,993 and 3,410,766, an electrically leaky, blue-colored film is produced which dissolves upon turning off the current, resulting in the discoloration of the electrolyte. A small amount of water is a necessary constituent of the anodizing solutions of the present invention.

The objects of the present invention are: to provide an anodized film substantially of $TiO_2$ having high intrinsic dielectric properties with a low leakage current in the presence of an electric field; and to provide a process for creating a passive film on titanium/titanium alloy articles that significantly improves the corrosion resistance of the articles.

Dielectric Characteristics

A dielectric is a substance capable of supporting electric strain. A substance having a high dielectric strength offers resistance to the communication of electric charges on one part of the substance to any other part. The dielectric constant of any substance, also known as the relative permitivity, is a measure of the electric charge a substance can withstand at a given electric field strength. Dielectric constant is not the same as dielectric strength which is a measure of the resistance of a substance to breakdown in a strong electric field, usually expressed in volts per centimeter, where breakdown is made evident by sparking and arcing. Dielectric substances are effective electrical insulators. The values of dielectric constants for various substances are as follows: aluminum oxide ($Al_2O_3$) between 8 and 11 and between 4.5 and 8.4; tantalum oxide ($Ta_2O_5$) between 21 and 50; titanium oxide ($TiO_2$) between 14 and 110 and between 89 and 173. The reported values for the dielectric constants vary for any given material. One of the reasons for the variation is that the permitivity of a crystalline substance is a tensor. That is, the dielectric constant depends upon the direction in which it is measured relative to the principal axes of the crystal. Another reason for the variation of the dielectric constant is that certain impurities lead to weak oxide films after anodizing. Other impurities may enhance the dielectric constant in a given material. One other reason for the variation of the dielectric constance is the degree of crystallinity within the oxide. For a truly amorphous film beyond a few atom layers thick, the tensor nature of the dielectric constant may reduce effectively to that of a simple scaler, and have the same value in all directions. Such a scaler value again may or may not be some average tensor value. Values for the dielectric constant in amorphous thin films formed by anodizing may be calculated from the measured capacitance, known thin film thickness, and the surface area. Also the dielectric constant may be a function of the frequency of the alternating electrical potential applied and the temperature of the substance. Unless the crystallinity, measurement conditions, and purity are completely specified, various references may not agree as to the dielectric constant of any given substance.

Dielectric substances are vital to devices such as capacitors that are required to store electricity in electronic circuitry. The capacitance of such devices varies directly with the dielectric constant and inversely with the distance separating the storage conductors. This invention succeeds in providing titanium/titanium alloy articles having thin dielectric films substantially of $TiO_2$ with low leakage currents.

Dielectric strength and residual leakage current are equally important, as it is necessary to retain charge and withstand high voltages without sparking or arcing before a dielectric can be considered to be effective. High dielectric strengths permit high voltage gradients in any application.

The high dielectric constant and the high dielectric strength of $TiO_2$ have not heretofore been accepted in commercial use in passive devices because of the high leakage rates and low breakdown potential resulting from conventional anodizing or oxidation in air at more or less elevated temperatures. This invention solves the earlier problems of undesirable $TiO_2$ films. The titanium/titanium alloy articles of this invention exhibit high dielectric strength with low leakage rates and high breakdown potentials. Basically the process for obtaining the titanium/titanium alloy articles of this invention is to anodize titanium or titanium alloys in a solution comprised of a mineral acid such as phosphoric acid in a substantially non-aqueous organic solvent.

Titanium and its alloys are among the so-called valve metals. That is, after anodizing, the resulting thin film substantially of $TiO_2$ passes electrical current readily only in one direction. Such materials are useful for application in passive devices such as electrolytic capacitors. For a given anodizing procedure, each valve metal has a maximum DC forming (anodizing) voltage. Typical maximum DC forming voltages are 750 for aluminum and 500 for tantalum. The allowable maximum working voltage of a capacitor in actual use is a function of its forming voltage. Dielectric strength therefore is of significant importance in electrolytic capacitors.

Corrosion Resistance

The titanium/titanium alloy articles of this invention exhibit high corrosion resistance. Corrosion in one form or another is the primary reason why metals deteriorate in use. While titanium is normally corrosion resistent in oxidizing environments, in many applications it exhibits finite, if small corrosion rates. In medical applications these can be significant.

Metallic titanium surfaces react with air and water from the environment to form thin layers of $TiO_2$ on its surface. The oxidation reaction is slow at ambient temperatures and not immediately obvious to the eye. After an elapse of time in contact with air or moisture a clear bright and shiny surface of a titanium/titanium alloy article becomes dull and tarnished. Few oxides are more stable or form with more energy than $TiO_2$. The $TiO_2$ oxidation product is crystalline and on the macro scale it completely covers the surface of the article. In effect $TiO_2$ provides a barrier layer that is essentially inert towards oxidizing environments. However, on the micro scale the coverage is not perfect because $TiO_2$ crystallites impinge on one another during growth and leave crevices, microcracks, and voids because of mismatches in their latice orientation. It is the crystalline form of $TiO_2$, imperfect as it is on the micro scale, that gives rise to the corrosion resistance of titanium. These small imperfections are also responsible for the leakage current such films exhibit under impressed voltages. Improved continuity is an essential feature of the anodized films forming part of the articles of this invention.

High strength titanium alloys are used in the production of prosthetic devices. Prosthetic devices, or implants, substitute for bone or joints in the human body and commonly attach to bone. $TiO_2$ is not toxic and is chemically inert toward human body fluids and sera. $TiO_2$ films thus provide effective barriers to corrosion and ion leakage into the human system. Ion leakage, or as it is used in medical literature "release rate," is a serious consideration when selecting prosthetic materials. The most common titanium alloy presently used in load bearing implants contains vanadium, an experimental carcinogen, and aluminum which is also toxic. The titanium/titanium alloy articles of this invention include anodized films substantially of $TiO_2$ that are significantly more impervious to ion leakage than have heretofore been available.

Other than toxicity and corrosion, issues involved in the prosthetic material selection decision are: implant mechanical stiffness; material density; tensile and compressive strength; and fatigue resistance in complex stress states. Titanium and certain of its alloys meet all of the basic needs of prosthetic devices better than most alternative materials. Commercial purity titanium has found use for implant devices such as pace makers, pumps, and bellows. Commercial purity titanium however is not very strong, so it is not used where a prosthetic device, such as a hip joint, must bear significant loads. For implants requiring high strength, the titanium alloy designated Ti-6Al-4V ELI has found extensive use for hip and other joint replacements. The aluminum and vanadium in that alloy are toxic and there is genuine concern that they pose a potential threat to the health and conditions of the users. It also has been found that Ti-6Al-4V ELI has a finite ion release rate in the human body and it is also much stiffer than human bone which gives rise to uneven load transfer between the bone and the device. Such devices tend to loosen in time and require replacement with attendant surgical risks and high costs.

A titanium alloy containing molybdenum, zirconium, and iron as alloy additions has been developed that addresses some of the problems of the other titanium alloys. Implants constructed of the molybdenum/zirconium/iron titanium alloy provide a much better match for bone in stiffness and are expected to last much longer before replacement is required. Although this alloy is more corrosion resistant toward human sera than is unalloyed titanium or Ti-6Al-4V ELI nevertheless the small but finite corrosion rates in its ordinary state remain a longer term medical issue. Although molybdenum and iron are less toxic than vanadium those alloying elements still pose a threat to human use, particularly for implants expected to last for many years. By surface coating devices using molybdenum/-zirconium/iron titanium alloy with an anodized film in accordance with this invention, the possibility of ions being exchanged between the prosthetic devices and the human recipients is substantially reduced.

This invention significantly improves the corrosion resistance of titanium and its alloys to body fluids and other corrosive environments. The articles of this invention while offering orders of magnitude improvements over the base material in corrosion rates toward human sera under typical conditions, may not be a total barrier to material release into the human system. Finite corrosion rates are usually measurable on devices manufactured according to this invention. This invention offers the prosthetic industry a significant improvement in corrosion resistance; reduced ion release rates; and higher breakdown potential, which is the electrical potential above which the material surface actively corrodes and releases substrate ions freely.

DESCRIPTION OF PREFERRED EMBODIMENTS

According to the present invention, the basic anodizing procedure is to mix a mineral acid such as $H_3PO_4$ with a substantially non-aqueous organic solvent to create a solution which is a poor donor of hydrogen ions while providing an available source for the oxygen needed in the creation of the film; and then to electrolyze using titanium or a titanium alloy as the anode and any suitable electrode material for a cathode. Titanium, austenitic stainless steel and graphite are all suitable cathodes. Table 1 lists solutions that have been found useful for anodizing according to this invention.

TABLE 1

| Constituents Useful for Anodizing According to this Invention | |
|---|---|
| Phosphoric Acid (85%) | 5-25% by volume |
| Propylene Carbonate | 5-95% by volume |
| Ethylene Carbonate | 5-95% by volume |
| Butyrolactone | 5-95% by volume |
| Sulfolane | 5-95% by volume |
| Dimethyl Sulfoxide | 5-95% by volume |
| N-2 Ethyl Pyrrolidone | 5-95% by volume |
| N-2 Methyl Pyrrolidone | 5-95% by volume |
| Propylene Glycol | 5-50% by volume |
| Dibutyl Phosphate | 5-50% by volume |
| Urea | 1-25% by volume |
| Water | 1-10% by volume |
| 4-Picoline | As sufficient |
| Silver Nitrate | As sufficient |
| Hydrotalcite | As sufficient |
| Calcium Phosphate | As sufficient |

The composition ranges set forth in Table 1 are not absolute and it is possible in many cases to mix two or more solvents or modifiers together for improved results. The ranges given in Table 1 have been found to be useful ranges.

Halides are generally harmful to the anodizing process. Additions to the solution useful for suppressing free chloride include silver nitrate and hydrotalcite. Halide controlling additions need to be made only in such amounts found to be effective. When using silver nitrate for this purpose, the appearance of the yellow silver phosphate signals the excess of silver over halide. It is also noted that certain nitrates and organics can form explosive mixtures. Silver nitrate should be added only in such sparing amounts as necessary to precipitate chloride ions. It is also known that various grades of titanium contain small amounts of chloride ions. It is therefore useful to employ materials produced by consolidation techniques that reduce chloride levels as low as possible. Electron beam melting or remelting of low chloride feed stock is one such method. Also, phosphate of calcium is useful for suppressing free fluoride in solution.

Other additives such as amines are useful for reducing resistivity and facilitating ion transport. The amine for this purpose is preferably chosen from the group of pyridine or substituted pyridines. A useful pyridine for this purpose is 4-picoline which is soluble in water as well as aprotic solvents and does not form phosphate salts. However, aminic buffers may complex silver in which case alternate means for controlling chloride may be necesssary. Urea is also useful in lowering the resistivity of the electrolyte consisting of dimethyl sulfoxide and phosphoric acid. A solution containing 100 ml. of dimethyl sulfoxide and 5 ml. of phosphoric acid has a resistivity of about 21,000 ohm-cm. at 23° C. The addition of 5 grams of urea to this solution lowers the resistivity to about 16,000 ohm-cm. An additional 10 grams of urea lowers the resistivity to about 8,500 ohm-cm.

Phosphoric acid is hygroscopic as are its solutions in organic solvents. Limiting water ingress during the life of the solution is helpful in maintaining electrolyte composition. Vacuum fractionalization is one useful method for removing excess water while returning other constituents to the system. Phosphate ions may be consumed during the anodizing process requiring periodic additions of $H_3PO_4$.

In order to maintain the proper composition of the solution several physical properties may be monitored. Physical properties useful to various degrees include: color (or spectra), refractive index, density electric resistivity, and surface tension. Chemical properties such as redox level, acid to base ratio, and contaminant concentration are also useful for monitoring and controlling electrolyte composition.

The optium solution resistivity depends on a particular setup and the results desired. The life of an anodizing solution is governed by its ability to anodize to a desired specification as well as its ability to be purified and recycled for further use. This will vary according to a particular setup and desired requirements.

The electrical parameters are also important to the anodizing process. Anodizing is more effecient when: (1) The formation current does not cause gas evolution on the article being anodized. Violation of this principle is not necessarily destructive of film formation but gas evolution makes comparisons among anodizing results more difficult. (2) Low levels of impurities such as halides are present in the anodizing solution and the metal being anodized. Halides tend to cause perforations, blisters, and film piercing conduits. (3) The anodizing solution is maintained at strength as an oxygen donor for film forming purposes. (4) The phosphate concentration in solution is maintained. (5) The solution resistivity is in the range of about 1000 to 50,000 ohm-cms. (6) Solution temperature is maintained at optimum for the system. (7) Water content is held to low levels (i.e., "substantially non-aqueous"), preferably below 10% by volume.

Formation currents that are too low require inordinate times to complete anodization. For that reason anodizing currents above about 0.1 milliamps per square cm. of surface would normally be used. The upper limit for formation current depends on the solution, the material being anodized, anodizing temperature and second order effects. The formation current may be as high as 25 milliamps per square cm. or even more in some cases. 1.0 milliamp per square cm. is a useful starting point for the anodizing process.

The anodizing process of this invention may be carried out in a variety of ways. Using a maximum current and fixed voltage settings on the power supply is both a useful and direct way to start. Good results have also been obtained by driving the voltage upward at a fixed rate to a set point. Either way, anodization may then be completed under constant voltage or not as desired. The article to be anodized may also be electrified instantaneously to a fixed voltage with or without an external resistor. The preferred method used depends in part upon a particular setup, voltage, solution and time available. For a minimum leakage current in reasonable time, the constant formation current method provides reproducible results and offers simplicity in operation. For a maximum formation voltage a high total circuit resistance is advantageous. For the most rapid age down to a given leakage current the formation current must be optimized for the condition chosen. The usual sequence of events after anodization begins according to the constant current method is an initial period where the voltage rises steadily up to the maximum set by the power supply. This period is known as the "formation period." Once the voltage reaches the set maximum, the current begins to drop. The period of decreasing current at constant voltage is known as the "age down period." Under these conditions the film first forms under increasing potential at constant current and then transitions to growth under decreasing current at constant potential. This procedure is facilitated by a power supply where the current and voltage are controllable independently. Similar results can be obtained by controlling the rate of voltage increase to the preset maximum. In any case the instantaneous potential across the film and other circuit elements is governed by the solution of Ohm's law across each element of the complete circuit. The potential drop across each element in the circuit therefore varies as anodization proceeds. Current decay to a steady statesignals the end of age down, the film no longer becoming more resistive with the passage of current. There is usually no point in continuing, and going on may at some point lead to an increase in current. Such an event is termed "grey out." The film integrity is being attacked during the grey out. Charting film resistivity as a function of total coulombs passed per square centimeter is a favorable way of following the anodizing events. It may be desirable to terminate the anodizing cycle prior to the completion of age down. This may be necessary, for example, if the onset of grey out occurs too suddenly to otherwise permit positive control. It would also be practical to terminate the anodizing cycle early in age down where the film resistivity reaches a desired value and there is nothing to be gained by continuing the process.

For a given final leakage current and other things constant, the applied voltage will control the anodized film thickness. The higher the voltage the thicker the film. For a given formation voltage, and other things constant, film thickness is a function of the total current passed per unit area unless grey out intervenes. Film thickness also depends on how much phosphate is incorporated into the film. It is noted that some phosphate incorporation is a common occurrence.

Solution or specimen agitation is useful, especially when anodizing under high current. Ultrasonic agitation or positive flow of solution past the electrode are each effective.

Specimen preparation is important to achieve film uniformity and cosmetic results. Titanium exposed to air and moisture over time develops an uneven surface oxide and stains that more or less interfere with the anodizing process. In constant current anodizing mode, any significant surface oxide present usually results in an "induction period" of constant voltage before the voltage begins its characteristic rise typical of the film formation period to the set value. The resulting film may be mottled or otherwise discolored. Dipping, etching, or pickling in a solution of 20–35 vol. % concentrated nitric acid and 1–5 vol. % concentrated hydrofluoric acid balance water has been found to be useful in removing surface oxides. Such etching eliminates the induction period. Etching is also useful for removing surface defects such as slivers of iron and other materials imbedded in the surface during fabrication. After surface oxide removal is complete the specimen must be rinsed thoroughly with deionized water or other highly pure solvents such as acetone. Drying of the specimen must thereafter be very carefully done. Residues of impurities from rinsing will result in uneven anodizing and mottled appearance.

Temperature is likewise important. Each solution has its own unique freezing range. Each solution has its own set of temperature dependencies for viscosity, electrical conductivity, and volatility. Each of these parameters influence the anodizing process.

Solution stability is also important. For repeated use, a solution should be stable over time. Similarly, the anodizing process should not excessively damage the solution. Anodizing according to the present invention results in some depletion of phosphate ions. It is therefore recommended that the solution be assayed for phosphate content on a periodic basis. The same is true for organic solvent, buffer, if used, water, and halide contents.

EXAMPLES

The following examples illustrate the various features of the present invention. In the examples solutions were made by milliliters unless otherwise noted. All solutions were substantially non-aqueous.

EXAMPLE 1

| | |
|---|---|
| Material | 99.99% pure titanium |
| Electrode form | 0.025 mm. foil |
| Electrode surface area | 6.90 sq. cm. |
| Solution | 10 ml phosphoric acid/100 ml propylene carbonate/100 ml butyrolactone |
| Formation current | 0.71 milliamp/sq. cm. |
| Formation voltage | 100 volts |
| Formation Efficiency | 89.6 megohms/coulomb/sq. cm. |
| Dielectric strength | 1.3 megavolts/cm. |
| Leakage current | 1.4 microamps/sq. cm. |

EXAMPLE 2

| | |
|---|---|
| Material | 99.99% pure titanium |
| Electrode form | 0.025 mm. foil |
| Electrode surface area | 25.0 sq. cm. |
| Solution | 10 ml. phosphoric acid/100 ml. |

-continued

| | |
|---|---|
| | propylene carbonate/0.1 g. silver nitrate |
| Formation current | 2.76 milliamps/sq. cm. |
| Formation voltage | 100 volts |
| Formation efficiency | 227 megohms/coulomb/sq. cm. |
| Dielectric strength | 5.4 megavolts/cm. |
| Leakage current | 2.2 microamps/sq. cm. |

EXAMPLE 3

| | |
|---|---|
| Material | 99.99% titanium |
| Electrode form | 0.025 mm. foil |
| Electrode surface area | 30.5 sq. cm. |
| Solution | 10 ml phosphoric acid/100 ml propylene carbonate/3.5 ml dibutyl phosphate (Kodak T5770) |
| Formation current | 0.82 milliamp/sq. cm. |
| Formation voltage | 100 volts |
| Formation efficiency | 120 megohms/coulomb/sq. cm. |
| Dielectric strength | 1.8 megavolts/cm. |
| Leakage current | 1.3 microamps/sq. cm. |

EXAMPLE 4

| | |
|---|---|
| Material | 99.99% pure titanium |
| Electrode form | 0.025 mm. foil |
| Electrode surface area | 33.8 sq. cm. |
| Solution | 10 ml. phosphoric acid/ 90 ml. N-2 ethyl pyrrolidone |
| Formation current | 0.90 milliamp/sq. cm. |
| Formation voltage | 150 volts |
| Formation efficiency | 646 megohms/coulomb/sq. cm. |
| Dielectric strength | 4.1 megavolts/cm. |
| Leakage current | 0.58 microamps/sq. cm. |

EXAMPLE 5

| | |
|---|---|
| Material | 99.99% pure titanium |
| Electrode form | 0.025 mm. foil |
| Electrode surface area | 10.5 sq. cm. |
| Solution | 10 ml. phosphoric acid/ 20 ml. propylene glycol/ 80 ml. propylene carbonate |
| Formation current | 0.77 milliamp/sq. cm. |
| Formation voltage | 180 volts |
| Formation efficiency | 45 megohms/coulomb/sq. cm. |
| Dielectric strength | 2.2 megavolts/cm. |
| Leakage current | 4.5 microamps/sq. cm. |

EXAMPLE 6

| | |
|---|---|
| Material | 99.99% pure titanium |
| Electrode form | 0.025 mm. foil |
| Electrode surface area | 14.4 sq. cm. |
| Solution | 10 ml. phosphoric acid/ 130 ml. dimethyl sulfoxide/ 7 g. urea |
| Formation current | 1.14 milliamp/sq. cm. |
| Formation voltage | 208 volts |
| Formation efficiency | 402 megohms/coulomb/sq. cm. |
| Dielectric strength | 3.5 megavolts/cm. |
| Leakage current | 0.80 microamps/sq. cm. |

EXAMPLE 7

| | |
|---|---|
| Material | 99.99% pure titanium |

-continued

| | |
|---|---|
| Electrode form | 0.025 mm. foil |
| Electrode surface area | 31.4 sq. cm. |
| Solution | 10 ml. phosphoric acid/ 40 ml. N-2 ethyl pyrrolidone/ 40 ml. N-2 methyl pyrrolidone/ 0.5 g. hydrotalcite |
| Formation current | 1.27 milliamp/sq. cm. |
| Formation voltage | 250 volts |
| Formation efficiency | 133 megohms/coulomb/sq. cm. |
| Dielectric strength | 2.5 megavolts/cm. |
| Leakage current | 1.7 microamps/sq. cm. |

EXAMPLE 8

| | |
|---|---|
| Material | 99.99% pure titanium |
| Electrode form | 0.025 mm. foil |
| Electrode surface area | 38.0 sq. cm. |
| Solution | 10 ml. phosphoric acid/ 45 ml. sulfolane/65 ml. N-2 methyl pyrrolidone |
| Formation current | 1.47 milliamp/sq. cm. |
| Formation voltage | 300 volts |
| Formation efficiency | 91 megohms/coulomb/sq. cm. |
| Dielectric strength | 5.2 megavolts/cm. |
| Leakage current | 5.2 microamps/sq. cm. |

EXAMPLE 9

| | |
|---|---|
| Material | 99.99% pure titanium |
| Electrode form | 0.025 mm. foil |
| Electrode surface area | 30.1 sq. cm. |
| Solution | 10 ml. phosphoric acid/ 40 ml. N-2 ethyl pyrrolidone/ 40 ml. N-2 methyl pyrrolidone/ 0.5 g. hydrotalcite |
| Formation current | 1.84 milliamp/sq. cm. |
| Formation voltage | 367 volts |
| Formation efficiency | 185 megohms/coulomb/sq. cm. |
| Dielectric strength | 2.6 megavolts/cm. |
| Leakage current | 1.3 microamps/sq. cm. |

EXAMPLE 10

| | |
|---|---|
| Material | 99.99% pure titanium |
| Electrode form | 0.025 mm. foil |
| Electrode surface area | 22.3 sq. cm. |
| Solution | 10 ml. phosphoric acid/ 100 ml. N-2 methyl pyrrolidone |
| Formation current | 1.13 milliamp/sq. cm. |
| Formation voltage | 475 volts |
| Formation efficiency | 234 megohms/coulomb/sq. cm. |
| Dielectric strength | 3.3 megavolts/cm. |
| Leakage current | 1.3 microamps/sq. cm. |

EXAMPLE 11

| | |
|---|---|
| Material | 99.99% pure titanium |
| Electrode form | 0.025 mm. foil |
| Electrode surface area | 21.5 sq. cm. |
| Solution | 10 ml. phosphoric acid/ 75 ml. N-2 methyl pyrrolidone/ 1.0 g. hydrotalcite |
| Formation current | 2.03 milliamp/sq. cm. |
| Formation voltage | 475 volts |
| Formation efficiency | 213 megohms/coulomb/sq. cm. |
| Dielectric strength | 3.0 megavolts/cm. |
| Leakage current | 1.3 microamps/sq. cm. |

EXAMPLE 12

| | |
|---|---|
| Material | 99.99% pure titanium |
| Electrode form | 0.025 mm. foil |
| Electrode surface area | 25.8 sq. cm. |
| Solution | 10 ml. phosphoric acid/ 90 ml. N-2 methyl pyrrolidone |
| Formation current | 0.90 milliamp/sq. cm. |
| Formation voltage | 500 volts |
| Formation efficiency | 12 megohms/coulomb/sq. cm. |
| Dielectric strength | 3.0 megavolts/cm. |
| Leakage current | 23.0 microamps/sq. cm. |

Examples 1 through 12 illustrate the following features of the present invention:

(1) Nominal leakage currents after formation of about 0.5-25 microamps per sq. cm. This leakage current range indicates high corrosion resistance.

(2) A dielectric strength from about 1-5 million volts per cm.

(3) A high film formation efficiency above 10 megohms/coulomb/sq. cm.

(4) The variety of solutions that can be used.

(5) Formation voltages up to 500 volts.

(6) An organic phosphate can be substituted for $H_3PO_4$ in part.

The dielectric strengths illustrated are more than an order of magnitude larger than values known for rutile, a naturally occurring form of crystalline $TiO_2$. In the above examples (1-12) the film thickness was calculated from the coulombs per square centimeter of current passed and the theoretical equivalent film thickness of $TiO_2$, and this number divided into the applied voltage gives the dielectric strength. Independent measurements of film thickness show this procedures to be adequate. These values of dielectric strength arise in part because of the intrinsic dielectric strength of the anodized films formed according to this invention and in part because the electrolyte used for anodizing is not a good electron donor so that electronic sparking tends nor to occur in situ. Phosphate incorporated into the film may contribute in some way to the high dielectric strength. The significance of these values is that they are similar to those known to $Ta_2O_5$ and $Al_2O_3$ under anodizing conditions. Values of this magnitude when combined with low leakage currents are not heretofore known for anodized titanium.

High purity electronic grade titanium with about 30 ppm total metallic impurities was used in Examples 1-12. The total gas content of the specimens was about 500 ppm, principally oxygen. The surfaces were prepared by etching to enhance the specimen area and also to remove surface impurities resulting from the specimen manufacturing operations and storage. The specific current leakage noted for Examples 1-12 are conservative figures since the true area exposed to the electrolyte was larger than the nominal value. It was also found that the solution used for Example 2 was stable for at least several weeks and was usable repeatedly. The solution used for Example 7 was found to be useful for multiple anodizations, but deteriorated after extended time of use.

In Examples 1-12 a film formation efficiency is reported in terms of resistance per coulomb per square centimeter. This number provides a relative value. Low numbers of formation efficiency reflect oxygen evolution, film dissolution, non-stoichiometric oxide or hydrate formation, variable amounts of phosphate, carbon or hydrogen incorporation and holes or blisters of one form or another in the film. The efficiency numbers are useful as a guide in real time for monitoring anodizing progress and effectiveness. High anodizing efficiencies tend to go with low final leakage rates for a given passage of current per unit surface area. Corrosion rate is directly related to leakage rate. When the leakage rate is low, corrosion rate is also low.

The adverse effect of halides in solution on final leak rate may be reversed by the addition of silver nitrate. The following Example 13 illustrates this feature for a 10 ml. phosphoric acid/90 ml. propylene carbonate solution anodizing high purity titanium at 100 volts.

EXAMPLE 13

Effect of silver nitrate on final leak rate.

Effect of silver nitrate on final leak rate.

| Run Number | 6 | 7 | 8* | 9* |
|---|---|---|---|---|
| Formation milliamps | 0.61 | 6.3 | 1.1 | 2.8 |
| Kilo seconds run time | 21 | 31 | 24 | 21 |
| Final microamp per sq. cm. leakage | 3.7 | 5.9 | 3.3* | 2.2* |

*Silver nitrate addition in amount sufficient to form silver phosphate.

Hydrotalcite had a similar effect on final leakage amount when added in amounts of about 1 gram per 500 ml. of solution.

High material purity is important but not vital. A commercial grade of titanium was anodized with the results shown in Example 14 below.

EXAMPLE 14

| | |
|---|---|
| Material | 99.7 pure titanium |
| Electrode form | Corrosion specimen |
| Electrode surface area | 8 sq. cm. |
| Solution | 10 ml phosphoric acid/ 90 ml propylene carbonate |
| Formation current | 0.6 milliamps/sq. cm. |
| Formation voltage | 100 volts |
| Formation efficiency | 15 megohms/coulomb/sq. cm. |
| Dielectric strength | 1.6 megavolts/cm. |
| Leakage current | 10 microamps/sq. cm. |

The material used in Example 14 had a total gas content on the order of 1000 ppm. Metal purity is advantageous in that the anodization sequence tends to be more effective and efficient (less sparking), the final breakdown voltage tends to be higher and the final leakage rate tends to be lower.

Another way to increase the breakdown voltage in situ is to add an external resistor. One such example is a solution of 10 parts propylene carbonate and 1 part phosphoric acid. This solution is best suited for anodizing below about 200 volts. An external resistor in the circuit permitted anodizing to 400 volts without sparking or significant gas evolution. Example 15 below provides the detail.

EXAMPLE 15

| | |
|---|---|
| Material | 99.99% pure titanium |
| Electrode form | 0.025 mm. foil |
| Electrode surface area | 41.3 sq. cm. |
| Solution | 10 ml phosphoric acid/ 90 ml propylene carbonate |
| External Series Resistor | 10,240 ohms |
| Formation current | 0.6 milliamp/sq. cm. |
| Formation voltage | 400 (399.95 across film at end) |

-continued

| | |
|---|---|
| Formation efficiency | 250 megohms/coulomb/sq cm |
| Dielectric strength | 2.7 megavolts/cm. |
| Leakage current | 0.99 microamps/sq. cm. nominal |

The solution of Example 15 had a resistivity of 7500 ohm-cms at room temperature.

The external resistor reduced the fraction of the circuit total applied electrical potential that the anodized film realized throughout the anodization cycle. The total circuit resistance influences the potential and its time derivatives under which the film grows with time while becoming thicker and more resistive to the passage of electric current. High formation voltages lead to high breakdown voltages in the film. The electrical potential required to cause an anodized film to break down is significant to capacitors since it is the breakdown potential that limits their voltage rating in service. High breakdown potentials, moreover, generally are directly related to high corrosion resistance. This feature is important to implants, prosthetics, and anywhere that titanium comes in contact with corrosive media.

The present invention is not limited to unalloyed titanium. The titanium alloy designated Ti-6Al-4V was anodized with results shown in Example 16 below.

EXAMPLE 16

| | |
|---|---|
| Material | Ti-6Al-4V |
| Electrode form | 3 mm. plate |
| Electrode surface area | 32 sq. cm. |
| Solution | 10 ml phosphoric acid/ 90 ml propylene carbonate |
| Formation current | 1.1 milliamp/sq. cm. |
| Formation voltage | 100 volts |
| Formation efficiency | 38 megohms/coulomb/sq. cm. |
| Dielectric strength | 1.3 megavolts/cm. |
| Leakage current | 3.3 microamps/sq. cm. nominal |

The combination of formation voltage and leakage current is not known for Ti-6Al-4V heretofore.

It is to be understood that the properties of the articles formed and illustrated herein and the proposed uses described earlier are neither limiting nor inclusive but were given to distinguish thin anodized films on titanium/titanium alloys according to the present invention from similar metal articles known heretofore. It is also to be understood that the solvents and other additives listed in Table 1 demonstrate the substantially non-aqueous anodization solution concept and that the lists of those solvents and additives are neither inclusive or limiting. There are numerous organic solvents, amines or other additives that may be substituted in whole or in part for those listed and give substantially the same results.

While I have shown and described present preferred embodiments of the articles of this invention and have also described certain present preferred processes of producing the articles, it is to be distinctly understood that the invention is not limited thereto but may be otherwise variously embodided within the scope of the following claims.

I claim:

1. A process for producing an article of titanium, comprising the steps of:

arranging a base metal body formed in any desired shape from titanium of 99.997% purity in all metalics and of less than 500 ppm total gases, as an anode in electrolytic communication with a cathode in a substantially non-aqueous solution of a mineral acid and an organic solvent, the solution characterized as being a poor donor of hydrogen ions and a provider of oxygen; and electorlyzing at a leakage current of between about 1.0 and 5.0 milliamps per square centimeter to form an anodized film on the surface of said base metal body.

2. The process as set forth in claim 1 wherein said electrolyzing is conducted at a formation current above about 0.1 milliamps per square centimeter.

3. The process as set forth in claim 1 wherein said electrolyzing is conducted at a formation voltage below that necessary to cause gas evolution from said base metal body.

4. The process as set forth in claim 1 wherein said mineral acid is phosphoric acid between about 5.0 and 25 percent by volume in said solution.

5. The process as set forth in claim 1 wherein said electrolyzing is at a formation current between about 0.1 and 25 milliamps per square centimeter.

6. The process as set forth in claim 1 wherein said electrolyzing is conducted at a substantially constant current until the voltage maximum is reached and thereafter at a substantially constant voltage until the current decays below 25 milliamps per square centimeter with or without an external resistor.

7. The process as set forth in claim 1 wherein said electrolyzing is conducted by increasing the voltage at a substantially constant rate to a maximum set point and thereafter at a substantially constant voltage until the current decays below 25 microamps per square centimeter with or without an external resistor.

8. The process as set forth in claim 1 including the step of initially electrifying said base metal body to a predetermined fixed voltage with or without an external resistor.

9. The process as set forth in claim 1 wherein said electrolyzing is conducted by increasing voltage at constant current until a predetermined voltage is reached, maintaining said predetermined voltage until the current drops and remains constant, and terminating the process when the current reaches the constant steady state.

10. The process as set forth in claim 1 wherein said mineral acid is phosphoric acid, and said organic solvent is selected from the group consisting of propylene carbonate, ethylene carbonate, butyrolactone, sulfolane, dimethyl sulfoxide, N-2 ethyl pyrrolidone, N-2 methyl pyrrolidone, and propylene glycol.

11. The process as set forth in claim 1 wherein an additive selected from the group consisting of pyridine amines and urea are mixed with said solution to reduce its resistivity.

12. The process as set forth in claim 1 wherein an additive selected from the group consisting of silver nitrate and hydrotalcite is mixed with said solution for suppressing free chloride.

13. The process as set forth in claim 1 wherein calcium phosphate is mixed with said solution for suppressing free fluoride.

14. The process as set forth in claim 1 wherein dibutyl phosphate between about 5.0 and 50 percent by volume in said solution is used to provide a source of phosphate and oxygen.

15. The process as set forth in claim 1 wherein said electrolyzing is conducted at a formation voltage of about 475 volts.

16. The process as set forth in claim 1 wherein said electrolyzing is conducted to form an anodized film having a dielectric strength greater than 1.0 million volts per centimeter.

17. The process as set forth in claim 1 wherein said electrolyzing is conducted at a formation efficiency above 12 megohms per coulomb per square centimeter.

18. The process as set forth in claim 1 wherein said electrolyzing is conducted to form an anodized film incorporating phosphorous on the surface of said metal body.

19. An article comprising a body formed from a metallic material of titanium of 99.997% purity in all metallics and of less than 500 ppm total gases; and a coating of substantially $TiO_2$ formed by anodizing said body in a substantially non-aqueous solution of a mineral acid and an organic solvent the solution being characterized as being a poor donor of hydrogen ions and a provider of oxygen.

20. An article as set forth in claim 19 wherein said mineral acid is phosphoric acid between about 5.0 and 25 percent by volume in said solution.

21. An article as set forth in claim 19 wherein said coating of substantially $TiO_2$ is formed by anodizing said body at a formation voltage above about 0.1 milliamps per square centimeter.

22. An article as set forth in claim 19 wherein said coating of substantially $TiO_2$ is formed by anodizing said body at a formation voltage below that necessary to cause gas evolution from said body.

23. An article as set forth in claim 21 wherein said formation current is between about 0.1 and 25.0 milliamps per square centimeter.

24. An article as set forth in claim 19 wherein said mineral acid is phosphoric acid, and said organic solvent is selected from the group consisting of propylene carbonate, ethylene carbonate, butyrolactone, sulfolane, dimethyl sulfoxide, N-2 ethyl pyrrolidone, N-2 methyl pyrrolidone, and propylene glycol.

25. An article as set forth in claim 19 wherein said coating is formed by anodizing at a formation voltage of about 475 volts.

26. An article as set forth in claim 19 wherein said coating has a dielectric strength greater than 1.0 million volts per centimeter.

27. An article as set forth in claim 19 wherein said coating is formed by anodizing at a formation efficiency of above 12 megohms per coulomb per square centimeter.

28. An article as set forth in claim 19 wherein said coating incorporates phosphorous.

29. A titanium article of 99.997% purity in all metallics and of less than 500 ppm total gases characterized by having a leakage current less than about 25 microamps per square centimeter and a dielectric strength of at least one million volts per square centimeter, and having an anodized surface film substantially of $TiO_2$ formed an efficiency greater than one megohm per coulomb per square centimeter.

30. A titanium alloy article of 6 percent aluminum and 4 percent vanadium by weight and the balance titanium characterized by having a leakage current less than about 25 microamps per square centimeter and a dielectric strength of at least one million volts per square centimeter, and having a surface film substantially of $TiO_2$ formed at an efficiency greater than one megohm per coulomb per square centimeter.

31. A titanium alloy article consisting of more than 50 percent by weight of titanium the balance selected from the group consisting of molybdinum, zirconium and iron characterized by having a leakage current less than about 25 microamps per square centimeter and a dielectric strength of at least one million volts per square centimeter, and having an anodized surface film substantially of $TiO_2$ formed at an efficiency greater than one megohm per coulomb per square centimeter.

* * * * *